United States Patent [19]

Zinsmeyer

[11] 4,404,812

[45] Sep. 20, 1983

[54] METHOD AND APPARATUS FOR CONTROLLING THE OPERATION OF A CENTRIFUGAL COMPRESSOR IN A REFRIGERATION SYSTEM

[75] Inventor: Thomas M. Zinsmeyer, Pennellville, N.Y.

[73] Assignee: Carrier Corporation, Syracuse, N.Y.

[21] Appl. No.: 325,617

[22] Filed: Nov. 27, 1981

[51] Int. Cl.[3] ..... F25B 43/02; F25B 31/00

[52] U.S. Cl. ..... 62/84; 62/193; 62/217; 417/13

[58] Field of Search ..... 62/217, 224, 225, 231, 62/469, 84, 192, 193, 228 D, 157; 417/13, 281, 902; 73/861.61, 861.63; 340/606, 611

[56] References Cited

U.S. PATENT DOCUMENTS

| | | | |
|---|---|---|---|
| 3,149,478 | 9/1964 | Anderson et al. | 62/469 |
| 3,200,603 | 8/1965 | Wake et al. | 62/84 |
| 3,508,416 | 4/1970 | Miller | 62/84 |
| 4,198,860 | 4/1980 | King | 73/861.63 |

*Primary Examiner*—Albert J. Makay
*Assistant Examiner*—Harry Tanner
*Attorney, Agent, or Firm*—Donald F. Daley; David L. Adour

[57] ABSTRACT

A method and apparatus to prevent oil pump cavitation in a hermetically sealed vapor compression refrigeration system are disclosed. A hermetically sealed housing containing the refrigeration compressor transmission and oil supply reservoir is connected to the suction side of the compressor to equalize the pressure in the housing and the suction to the compressor is constructed with a restriction such as an orifice or a venturi to create a pressure drop or is of a size small enough to create a pressure drop when refrigerant flows through the line. The pressure drop is sensed by a pressure differential switch to anticipate sharp drops in pressure in the housing. The flow of refrigerant to the compressor is throttled in response to predetermined pressure drops to prevent a sharp drop in pressure within the transmission housing and thus prevent vigorous boiling of refrigerant from the oil reservoir. Prevention of vigorous boiling of the refrigerant from the oil prevents oil pump cavitation and loss of oil to the transmission and bearings of the compressor.

7 Claims, 3 Drawing Figures

METHOD AND APPARATUS FOR CONTROLLING THE OPERATION OF A CENTRIFUGAL COMPRESSOR IN A REFRIGERATION SYSTEM

FIELD OF THE INVENTION

This invention relates to vapor compression refrigeration machines and more particularly to a method and apparatus for controlling the operation of a centrifugal compressor to prevent vigorous boiling of refrigerant contained in the lubricating oil for the compressor transmission.

BACKGROUND OF THE INVENTION

In refrigeration machines of the vapor compression type, wherein the compressor and the compressor drive motor and transmission are hermetically sealed, liquid refrigerant is used to cool the motor driving the compressor. The oil used to lubricate the motor, the transmission and the compressor comes into contact with the refrigerant and absorbs a portion of the refrigerant. Excess oil is collected in a sump within the hermetically-sealed housing and an oil pump is used to recirculate the oil to the bearings and transmission requiring lubrication. Since the unit is hermetically sealed, the atmosphere within the housing is vaporized refrigerant. In order to reduce windage losses in the operation of the transmission it is desirable to keep the pressure of vaporized refrigerant within the housing as low as possible. This is normally accomplished by venting the transmission housing to the suction line of the compressor through a pressure equalization line. Because of the low pressure in the transmission, relatively small amounts of refrigerant are absorbed by the oil. However, during periods when the refrigeration machine is shut down, the pressure in the transmission housing increases and the amount of refrigerant absorbed by the oil increases. Upon start-up of the compressor, the pressure in the suction line to the compressor immediately drops causing a corresponding drop of pressure in the transmission housing. As a result of the drop in pressure in the transmission housing, the refrigerant absorbed in the oil tends to boil out of the oil as a vapor. If the boiling of the refrigerant is vigorous, oil foaming or cavitation of the oil pump results. Oil pump cavitation produces a loss of oil pressure in the system and, with safety controls protecting the equipment from damage from loss of oil pressure, the refrigeration machine is usually shut down. In order to avoid shutdown and recycling of the equipment, it is desirable to prevent foaming of the oil or oil pump cavitation. On prior commercial equipment, pressure sensing devices have been provided to sense oil pressure and, in the event of low oil pressure, to close inlet guide vanes in the compressor suction line thus reducing the rate of pressure drop in the suction line and in the transmission housing. However, when an oil pressure drop is sensed, oil pump cavitation has already occurred. The present invention is intended to both reduce the amount of boiling of refrigerant upon start-up of the compressor and to anticipate a condition which would create oil pump cavitation so that corrective steps may be taken prior to a drop in oil pressure.

SUMMARY OF THE INVENTION

It is the primary object of the present invention to reduce rapid vaporization of refrigerant absorbed in the oil refrigeration compressors.

It is also an object of the present invention to eliminate cavitation in oil pumps used in refrigeration machines during start-up of the refrigeration machine or during periods of sharp pressure drop at the suction side of the compressor used in the refrigeration machine.

It is a further object of this invention to control the operation of a refrigeration system to reduce the boiling action of refrigerant from oil used in a hermetically-sealed compressor during start-up of the refrigeration system and to eliminate shutdown and recycling of the compressor as a result of loss of oil pressure during start-up.

These and other objects of this invention are attained by means of a flow-restricting pressure equalization line or, a restriction positioned in a pressure equalization line between the housing for the transmission of a refrigeration machine compressor and the suction line to the compressor, and a pressure differential switch measuring the drop in pressure across the restriction. The pressure differential switch is operatively connected to control the operation of inlet guide vanes positioned in the suction line to the compressor. Upon detection of a predetermined pressure drop across the restriction, the guide vanes are closed reducing the rate of decrease in pressure in the suction line. This tends to reduce the differential across the equalization line, causing the flow in that line to diminish and thus reduces the rate of pressure drop in the housing. This minimizes the boiling action of the refrigerant in the oil and reduces the possibility of oil pump cavitation.

These and other objects and purposes of the invention will be apparent to persons familiar with refrigeration equipment when considered with the following specification and drawing.

DETAILED DESCRIPTION

Figure 1:
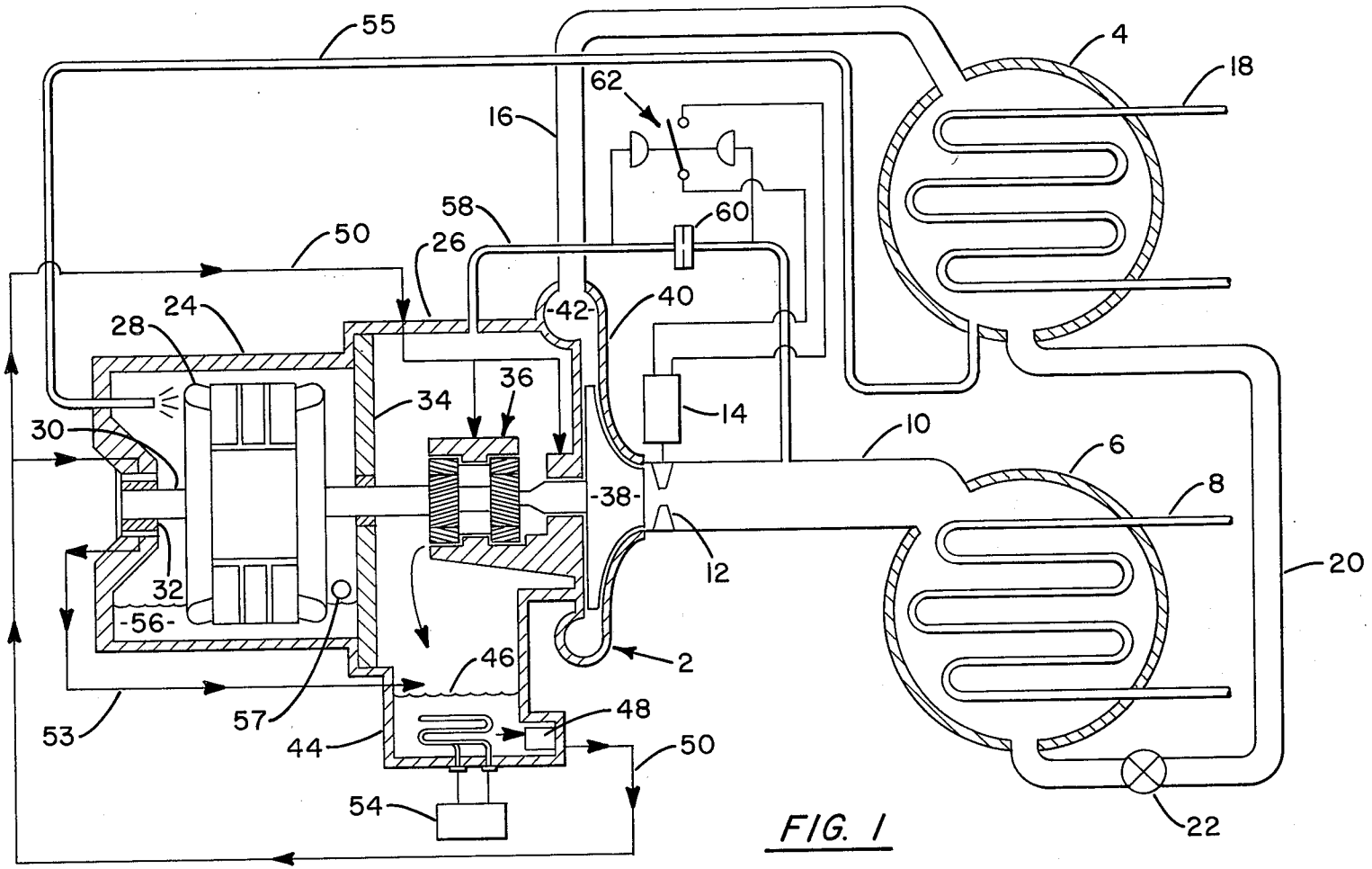
FIG. 1 is a schematic representation, in cross-section, of a refrigeration machine embodying the present invention.

Referring to FIG. 1, a refrigeration system is shown comprising a compressor 2, a condenser 4, and an evaporator 6. The condenser 4 and the evaporator 6 are shell and tube type heat exchangers. In the evaporator 6, heat is transferred from a heat exchanger medium such as water flowing through heat transfer tubing 8, to refrigerant in the evaporator 6. Gaseous refrigerant from the evaporator 6 flows to the compressor 2 through a suction line 10. The compressor 2 has inlet guide vanes 12 which control the amount of refrigerant flow to the compressor 2. The guide vanes 12 are regulated by a control mechanism 14, such as an electric motor, which opens and closes the vanes to limit refrigerant flow to the compressor and to control the suction pressure in the suction line 10. The position of guide vanes 12 are normally controlled by the temperature of the water in tubes 8 leaving the evaporator 6 thus regulating the capacity of the compressor in response to the load on the system. Vaporized refrigerant from the evaporator is compressed by the compressor 2 and passes through a discharge line 16 to the condenser 4. In the condenser 4 heat is transferred from the refrigerant to a cooling medium flowing through tubing 18 condensing the refrigerant to its liquid state. The liquid refrigerant from the condenser 4 passes to the evaporator 6 through line 20 and valve 22 to complete the closed loop heat transfer cycle.

Within a hermetically sealed motor housing 24, an electrical motor 28 is mounted on a drive shaft 30, one end of which is mounted in a sealed bearing 32 in the rear wall of the housing 24. The other end of the shaft 30 extends through an interior wall 34 separating the motor chamber from the transmission chamber. A transmission unit 36, mounted within the transmission housing 26, connects the drive shaft 30 to a compressor impeller 38. The motor 28 drives the impeller 38 through the shaft 30 and the transmission 36 to draw refrigerant vapor from the evaporator 6 through the suction line 10 and discharge compressed refrigerant gas through a diffuser 40 and the discharge outlet 42 to the discharge line 16.

At the bottom of the transmission housing 26, there is located a lubricating oil reservoir 44 containing a supply of lubricating oil 46. An oil pump 48 is located in the oil sump 44 beneath the level of the oil to pump oil through line 50 to lubricate the drive system including the drive shaft bearing 32 and transmission 36. Lubricating oil from the bearing 32 is returned to the reservoir through line 53. An oil heater 54 is located in the oil reservoir 44 to heat the oil to prevent undesirable amounts of refrigerant from being absorbed into the oil during periods of shutdown. However, even with the oil heater in operation, substantial amounts of refrigerant are absorbed by the oil during shutdown periods.

During normal operation of the compressor, liquid refrigerant is provided to the motor housing 24 from the condenser 4, through line 55 to cool the motor 28. The pressure in condenser 4 forces liquid refrigerant through line 55 to the motor housing 24 where it is sprayed on the rotor and stator of motor 28 to cool the motor. Part of the refrigerant is vaporized and returns to the evaporator 6 on the low pressure side of the system through opening 57 connected to a return line, not shown, to the evaporator. The unvaporized liquid refrigerant 56 collects in the bottom of the motor housing 24.

In a hermetically-sealed unit of the type described herein, the atmosphere within the transmission housing is comprised of vaporized refrigerant. In order to reduce the pressure within the transmission, the transmission housing is connected to the suction line 10 of the compressor through a pressure equalization line 58. In this manner, the pressure in the transmission housing is maintained at the suction pressure of the compressor. In addition, since the ability of oil to absorb refrigerant is dependent on both the pressure and temperature of the oil, the amount of refrigerant absorbed by the oil in the reservoir 44 is reduced during operation of the refrigeration system. During periods when the refrigeration system is not operating, the pressure in suction line 10 increases causing a corresponding rise in pressure in the transmission housing 26. The increase in pressure in the housing 26 results in additional refrigerant being absorbed by the oil in reservoir 44. When the pressure in housing 26 is reduced, the refrigerant in the oil will tend to vaporize and separate from the oil. If the pressure is dropped quickly, the refrigerant will vaporize rapidly and produce a vigorous boiling action which causes foaming of the oil. The oil pump 48 cannot efficiently pump foamed oil. This action causes cavitation of the oil pump producing a drop in oil pressure in the system. Safety controls normally built into the system will shut down the system to prevent damage to the motor or tansmission or bearings. Alternatively, it is known to close the guide vanes 12 in the suction line 10 when the oil pressure in the system drops. However, this type of control takes place after an undesirable condition is created. The present invention contemplates anticipating a drop in pressure in the transmission housing and adjusting machine conditions before a low oil pressure develops.

Figure 2:
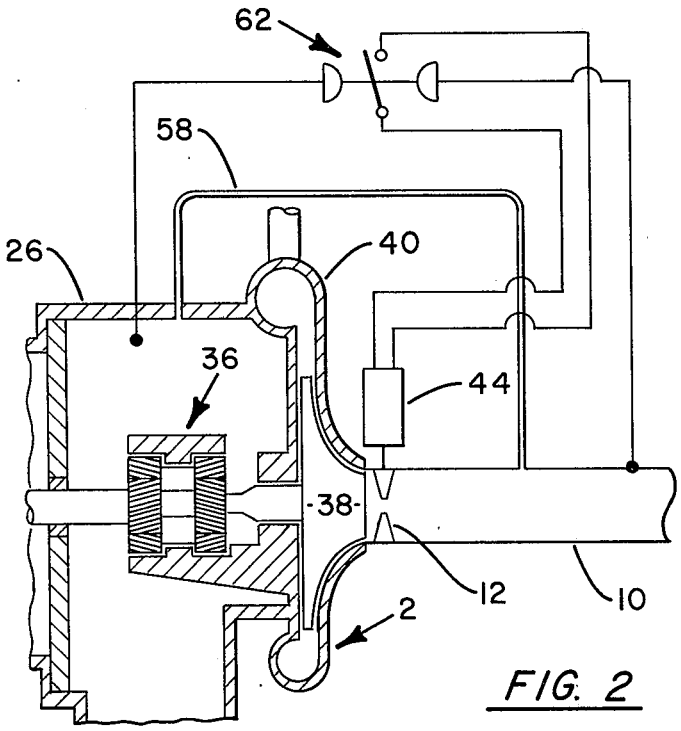
FIG. 2 is a schematic representation, in cross-section, of an alternate embodiment of the invention shown in FIG. 1.
Figure 3:
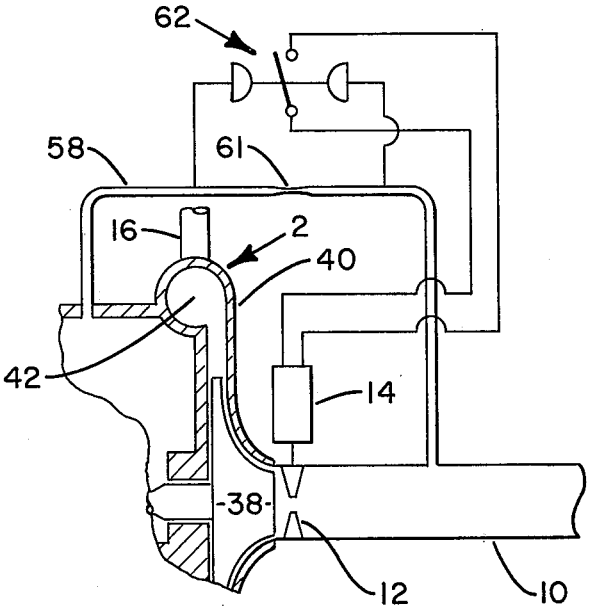
FIG. 3 is a portion of the pressure equalization line shown in FIG. 1 with a venturi-type restriction in place of an orifice.

In order to delay the transmission of sharp pressure drops in line 10 to transmission housing 26, such as occurs during start-up of compressor 2, an orifice 60 is located in pressure equalization line 58. When a pressure differential is created between housing 26 and suction line 10, vaporous refrigerant flows in pressure equalization line 58 and a pressure drop is established across orifice 60. Flow is restricted by the orifice and as a result, pressure in housing 26 decreases gradually. This delay slows down the vaporization of refrigerant from the oil 46 and allows the refrigerant to escape from the oil in a more gradual and controlled manner thus reducing foaming and pump cavitation. A pressure differential switch 62 is mounted across orifice 60 in pressure equalization line 58. The pressure differential switch will be actuated when a predetermined pressure drop exists across the orifice 60. The pressure differential switch 62 is electrically connected to the motor or controller 14 for the guide vanes 12 in suction line 10. The controller 14 for the guide vanes 12 is normally controlled by the temperature of the chilled water leaving the evaporator 6 through coils 8. However, the pressure differential switch 62 is electrically connected to these controls to override the normal guide vane controls so that the guide vanes will be closed when the switch 62 is closed in response to a predetermined pressure drop across the orifice 60. FIG. 3 shows the use of a venturi 61, or a restriction, in line 58, in place of orifice 60. The restriction 61 delays the transmission of the pressure drop in suction line 10 to the housing 26 in the same manner of the orifice 60. Referring to FIG. 2, an alternative embodiment is shown wherein the pressure equalization line 58 is very small to delay transmission of a pressure drop in suction line 10 to housing 26. The line 58 is large enough to allow pressure equalization over an extended period of time. The pressure differential switch 62 is connected directly to the suction line 10 and the housing 26 to detect a pressure differential and close guide vanes 12. It should be noted that in all embodiments the pressure switch 62 can be connected to detect pressure in suction line 10 and housing 26 or connected across the restriction in line 58. Alternatively the pressure switch 62 may be connected to measure pressure differential between the housing 26 and the evaporator 6.

Each of the embodiments shown is intended to anticipate sharp drops in pressure in housing 26 be measuring the pressure differential between the housing and the suction to the compressor, and increasing the pressure in the suction line 10 before the pressure in housing 26 drops to a point where oil pump cavitation will develop. When there is a pressure differential, switch 62 closes actuating the controls 14, causing the vanes 12 to close and reduce the rate at which pressure in line 10 decreases. The rate at which the pressure in housing 26 decreases will also slow down and the pressure differential between the housing and the suction line 10 will also decrease. The pressure differential switch 62 will then open actuating the controls 14 to return the guide vanes 12 towards an open position. This cycling action continues and the pressure in housing 26 is reduced in a controlled manner and the refrigerant is slowly vaporized from the oil 46.

Although particular preferred embodiments of the invention have been disclosed in detail, for illustration purposes, it will be recognized that variations or modifications of the disclosed apparatus lie within the scope of the present invention.

I claim:

1. A compressor control for use in vapor compression refrigeration system for controlling the operation of a hermetic centrifugal compressor having a transmission enclosed in a housing said housing having an oil reservoir for lubricating the transmission and an atmosphere of refrigerant, said control comprising:

means to equalize the pressure between the compressor suction and the atmosphere of refrigerant in the housing, means to detect a pressure differential between the compressor suction and the housing before equalization of the pressure in the housing occurs, and means to throttle the suction to the compressor upon the detection of a predetermined pressure differential between the compressor suction and the housing.

2. A compressor control for use in a vapor compression refrigerant system for controlling the operation of a hermetic centrifugal compressor having a transmission enclosed in a housing said housing having an oil reservoir for lubricating the transmission and an atmosphere of refrigerant, said control comprising:

a pressure equalization line between the compressor suction and the housing, means in the pressure equalization line to produce a pressure drop when refrigerant is flowing in the pressure equalization line, a pressure differential switch operatively associated with the pressure equalization line to detect a predetermined pressure drop across the pressure equalization line and to generate an electrical signal when a predetermined pressure drop is detected, and means to throttle the suction to the compressor in response to the signal generated by the pressure differential switch.

3. The compressor control of claim 2 wherein the means in the pressure equalization line to produce a pressure drop in an orifice.

4. The compressor control of claim 2 wherein the means in the pressure equalization line to produce a pressure drop is a venturi type restriction.

5. A compressor control for use in a vapor compression refrigeration system for controlling the operation of a hermetic centrifugal compressor of the type having a compressor casing housing a rotating impeller, a suction line connected to the inlet of the casing, a discharge line connected to the outlet of the casing, inlet guide vanes in the suction line to control the flow of refrigerant to the comprssor, control means to open and close the inlet guide vanes, and a housing hermetically enclosing a transmission for driving the impeller, and a lubrication oil reservoir, said control comprising a pressure equalization line connecting the suction line to the housing to equalize the pressure of vaporous refrigerant in the housing and the suction line to the compressor restriction means positioned in the pressure equalization line to localize the pressure drop between the housing and the suction line when there is flow of refrigerant from the housing to the suction line, a pressure differential switch connected across the restriction means and set to make or break electrical contacts when a predetermined pressure exists across the restriction means, said pressure differential switch being connected to the inlet guide vane control means to close the inlet guide vanes upon occurrence of the predetermined pressure differential across the restriction means and to allow said guide vanes to be opened when said predetermined pressure differential does not exist.

6. A method of controlling operation of a hermetically sealed centrifugal compressor in a vapor compression refrigeration system comprising the steps of maintaining pressure in a housing containing the compressor transmission and the oil supply of the compressor, at substantially the same pressure as the suction to the compressor detecting the occurrence of a predetermined pressure difference between the suction of the compressor and the housing throttling the suction to the compressor upon detection of the predetermined pressure difference to prevent a sharp drop in pressure in the housing.

7. In a vapor compression refrigeration system a method of controlling operation of a hermetically sealed centrifugal compressor to prevent rapid vaporization of refrigerant entrained in a supply of lubricating oil comprising the steps of providing pressure equalization between the suction to the compressor and a housing enclosing a supply of oil for the compressor determining when a pressure differential exists between the compressor suction and the housing closing guide vanes in the compressor suction when a predetermined pressure differential exists to increase the pressure in the suction to the compressor and to retard pressure drop in the housing, and allowing the guide vanes in the compressor suction to open when the pressure differential is reduced below a predetermined amount.

* * * * *